US010997885B2

(12) United States Patent
Kim et al.

(10) Patent No.: US 10,997,885 B2
(45) Date of Patent: May 4, 2021

(54) DISPLAY DEVICE AND METHOD OF DRIVING THE SAME

(71) Applicant: Samsung Display Co., Ltd., Yongin-si (KR)

(72) Inventors: Yoonsup Kim, Suwon-si (KR); Namsoo Kang, Asan-si (KR); Soonkyeong Kwon, Seoul (KR); Sunghyun Kim, Hwaseong-si (KR); Sewon Min, Asan-si (KR); Kihyun Sung, Incheon (KR); JunYong Ahn, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/270,955

(22) Filed: Feb. 8, 2019

(65) Prior Publication Data

US 2019/0259321 A1 Aug. 22, 2019

(30) Foreign Application Priority Data

Feb. 20, 2018 (KR) ..... 10-2018-0019836

(51) Int. Cl.
*G09G 3/20* (2006.01)
*G09G 3/36* (2006.01)
*G09G 3/3266* (2016.01)

(52) U.S. Cl.
CPC ..... *G09G 3/20* (2013.01); *G09G 3/3266* (2013.01); *G09G 3/3674* (2013.01); *G09G 2310/08* (2013.01)

(58) Field of Classification Search
None
See application file for complete search history.

(56) References Cited

U.S. PATENT DOCUMENTS

2017/0162123 A1* 6/2017 Choi ..... G09G 3/3291

FOREIGN PATENT DOCUMENTS

| | | | |
|---|---|---|---|
| KR | 10-2005-0046173 | A | 5/2005 |
| KR | 10-2017-0062611 | A | 6/2017 |
| KR | 10-2017-0081088 | A | 7/2017 |
| KR | 10-2017-0097255 | A | 8/2017 |

* cited by examiner

*Primary Examiner* — Aneeta Yodichkas
(74) *Attorney, Agent, or Firm* — Lewis Roca Rothgerber Christie LLP

(57) ABSTRACT

A display device includes a display panel including a plurality of pixels, a timing controller that generates a first reference clock signal having a first pulse and a second reference clock signal having a second pulse, a signal generator that generates a vertical start signal of which an activation period starts in response to the first pulse and the second pulse and generates a gate clock signal and an inverted gate clock signal based on the first pulse and the second pulse, and a gate driver that generates a gate signal based on the vertical start signal, the gate clock signal, and the inverted gate clock signal and provides the gate signal to the pixels.

20 Claims, 11 Drawing Sheets

DISPLAY DEVICE AND METHOD OF DRIVING THE SAME

CROSS-REFERENCE TO RELATED APPLICATION

This application claims priority to and the benefit of Korean Patent Application No. 10-2018-0019836, filed on Feb. 20, 2018 in the Korean Intellectual Property Office (KIPO), the contents of which are incorporated herein in its entirety by reference.

BACKGROUND

1. Field

Aspects of some example embodiments of the present invention relate generally to a display device.

2. Description of the Related Art

A display device includes a display panel and a panel driver. The display panel includes a plurality of gate-lines, a plurality of data-lines, and a plurality of pixels. The panel driver includes a gate driver that provides a gate signal to the pixels via the gate-lines and a data driver that provides a data signal to the pixels via the data-lines.

The gate driver may be formed in a chip form and mounted on the display panel. Alternatively, the gate driver may be integrated in an Amorphous Silicon Gate (ASG) form on a display substrate to reduce a size of the display device and to increase productivity. The gate driver may output the gate signal based on a vertical start signal and a gate clock signal.

The above information disclosed in this Background section is only for enhancement of understanding of the background of the invention and therefore it may contain information that does not constitute prior art.

SUMMARY

Aspects of some example embodiments of the present invention relate generally to a display device. For example, some example embodiments of the present inventive concept relate to a display device that includes a panel driver having the reduced number of wirings and a method of driving the display device.

Some example embodiments provide a display device that may reduce an integrated area of a panel driver.

Some example embodiments provide a method of driving the display device.

According to an aspect of some example embodiments, a display device may include a display panel including a plurality of pixels, a timing controller configured to generate a first reference clock signal having a first pulse and a second reference clock signal having a second pulse, a signal generator configured to generate a vertical start signal of which an activation period starts in response to the first pulse and the second pulse and to generate a gate clock signal and an inverted gate clock signal based on the first pulse and the second pulse, and a gate driver configured to generate a gate signal based on the vertical start signal, the gate clock signal, and the inverted gate clock signal and to provide the gate signal to the pixels.

In example embodiments, the signal generator may activate the vertical start signal when the signal generator concurrently receives the first pulse and the second pulse.

In example embodiments, the signal generator may determine a length of the activation period of the vertical start signal based on a duration time value received from a memory device.

In example embodiments, an activation period of the gate clock signal may start in response to the first pulse and a deactivation period of the gate clock signal may start in response to the second pulse. In addition, an activation period of the inverted gate clock signal may start in response to the second pulse and a deactivation period of the inverted gate clock signal may start in response to the first pulse.

In example embodiments, a voltage level of the gate clock signal may be inverted in response to the first pulse.

In example embodiments, the signal generator may include a selecting block configured to output first through third control signals based on the first reference clock signal and the second reference clock signal and a signal adjusting block configured to adjust voltage levels of the vertical start signal, the gate clock signal, and the inverted gate clock signal based on the first through third control signals.

In example embodiments, the selecting block may activate the first control signal when the first reference clock signal and the second reference clock signal correspond to an activation level. In addition, the signal adjusting block may set the vertical start signal to have an activation level based on the first control signal which is activated.

In example embodiments, the signal adjusting block may maintain the vertical start signal to have the activation level during a first duration time.

In example embodiments, the selecting block may activate the second control signal when the first reference clock signal corresponds to an activation level and when the second reference clock signal corresponds to a deactivation level. In addition, the signal adjusting block may set the gate clock signal to have an activation level and may set the inverted gate clock signal to have a deactivation level based on the second control signal which is activated.

In example embodiments, the selecting block may activate the third control signal when the first reference clock signal corresponds to a deactivation level and when the second reference clock signal corresponds to an activation level. In addition, the signal adjusting block may set the gate clock signal to have a deactivation level and may set the inverted gate clock signal to have an activation level based on the third control signal which is activated.

In example embodiments, the gate clock signal may include first through (k)-th gate clock signals, where k is an integer greater than 1. In addition, the inverted gate clock signal may include first through (k)-th inverted gate clock signals. Further, the first through (k)-th inverted gate clock signals may correspond to respective inverted signals of the first through (k)-th gate clock signals.

In example embodiments, an (i)-th gate clock signal may be a signal generated by delaying an (i−1)-th gate clock signal by a first time length, where i is an integer greater than 1 and smaller than or equal to k. In addition, an (i)-th inverted gate clock signal may be a signal generated by delaying an (i−1)-th inverted gate clock signal by the first time length.

According to another aspect of some example embodiments, a display device may include a display panel including a plurality of pixels, a timing controller configured to generate a first reference clock signal and a second reference clock signal, a signal generator configured to generate a vertical start signal, a gate clock signal, and an inverted gate clock signal based on the first reference clock signal and the second reference clock signal, and a gate driver configured to generate a gate signal based on the vertical start signal, the gate clock signal, and the inverted gate clock signal and to provide the gate signal to the pixels. Here, the signal generator may set the vertical start signal to have an activation level when the first reference clock signal and the second reference clock signal correspond to an activation level.

In example embodiments, the signal adjusting block may maintain the vertical start signal to have the activation level during a first duration time.

In example embodiments, the selecting block may set the gate clock signal to have an activation level and may set the inverted gate clock signal to have a deactivation level when the first reference clock signal corresponds to the activation level and when the second reference clock signal corresponds to a deactivation level.

In example embodiments, the selecting block may set the gate clock signal to have a deactivation level and may set the inverted gate clock signal to have an activation level when the first reference clock signal corresponds to the deactivation level and when the second reference clock signal corresponds to the activation level.

According to an aspect of some example embodiments, a method of driving a display device may include generating a first reference clock signal and a second reference clock signal, generating a vertical start signal, a gate clock signal, and an inverted gate clock signal based on the first reference clock signal and the second reference clock signal, generating a gate signal based on the vertical start signal, the gate clock signal, and the inverted gate clock signal, and displaying an image corresponding to a data signal in response to the gate signal. Here, the vertical start signal may be set to have an activation level when the first reference clock signal and the second reference clock signal correspond to an activation level.

In example embodiments, the vertical start signal may be maintained to have the activation level during a first duration time which is determined based on a duration time value received from a memory device.

In example embodiments, the gate clock signal may be set to have an activation level and the inverted gate clock signal may be set to have a deactivation level when the first reference clock signal corresponds to the activation level and when the second reference clock signal corresponds to a deactivation level.

In example embodiments, the gate clock signal may be set to have a deactivation level and the inverted gate clock signal may be set to have an activation level when the first reference clock signal corresponds to the deactivation level and when the second reference clock signal corresponds to the activation level.

Therefore, a display device according to some example embodiments may generate a vertical start signal as well as a plurality of gate clock signals and a plurality of inverted gate clock signals based on a first reference clock signal and a second reference clock signal. Thus, the display device may reduce the number of wirings which are connected between a timing controller and a signal generator because the display device does not need an additional wiring for generating the vertical start signal. Hence, the display device may reduce a size of a panel driver (e.g., a size of a printed circuit board (PCB)).

In addition, a method of driving a display device according to some example embodiments may simplify a panel driver by generating a vertical start signal based on a first reference clock signal and a second reference clock signal.

DETAILED DESCRIPTION

Hereinafter, aspects of some example embodiments of the present inventive concept will be explained in more detail with reference to the accompanying drawings.

Figure 1:
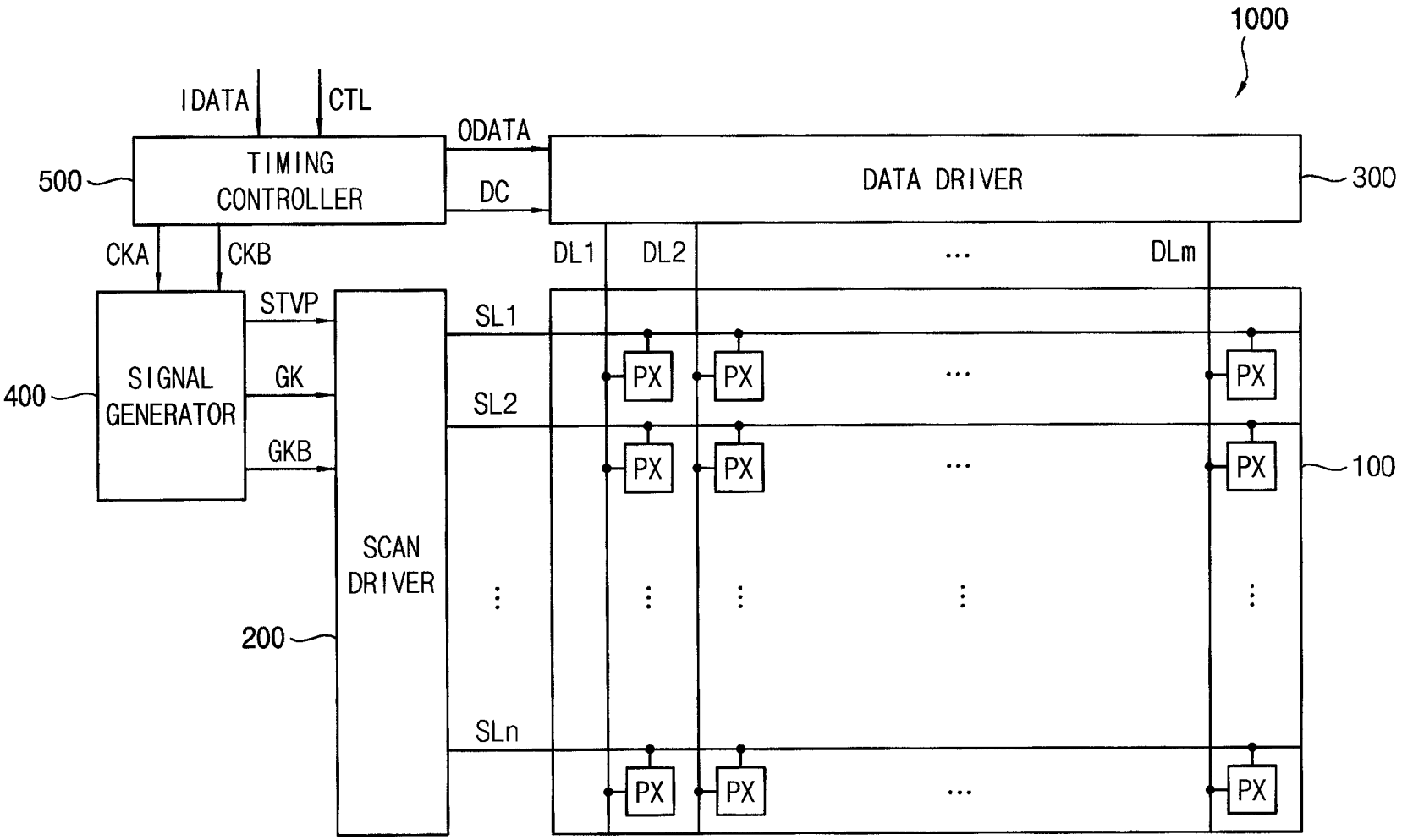
FIG. 1 is a block diagram illustrating a display device according to some example embodiments.

FIG. 1 is a block diagram illustrating a display device according to some example embodiments.

Referring to FIG. 1, the display device 1000 may include a display panel 100, a gate driver 200, a data driver 300, a signal generator 400, and a timing controller 500. In some example embodiments, the display device 1000 may be an organic light emitting display (OLED) device. In this case, the display device 1000 may further include an emission control driver that provides an emission control signal to pixels PX. In some example embodiments, the display device 1000 may be a liquid crystal display (LCD) device. In this case, the display device 1000 may further include a backlight assembly.

The display panel 100 may include a plurality of pixels PX to display an image. For example, the display panel 100 may include n×m pixels PX located at intersections of first through (n)-th gate-lines GL1 through GLn and first through (m)-th data-lines DL1 through DLm, where n and m are integers greater than 1.

The gate driver 200 may generate a gate signal based on a vertical start signal STVP, a gate clock signal GK, and an inverted gate clock signal GKB and may provide the gate signal to the pixels PX via the first through (n)-th gate-lines GL1 through GLn. In some example embodiments, the gate driver 200 may include a plurality of stages that sequentially output the gate signal which is activated to the first through (n)-th gate-lines GL1 through GLn.

The data driver 300 may convert digital image data ODATA into an analog data voltage (or a data signal) based on a data control signal DC and may provide the analog data voltage to the pixels PX via the first through (m)-th data-lines DL1 through DLm.

The signal generator 400 may generate the vertical start signal STVP, the gate clock signal GK, and the inverted gate clock signal GKB based on a first reference clock signal CKA and a second reference clock signal CKB. In some example embodiments, the signal generator 400 may control the vertical start signal STVP to have an activation level in response to a first pulse of the first reference clock signal CKA and a second pulse of the second reference clock signal CKB which are concurrently received. The signal generator 400 may maintain the vertical start signal STVP to have an activation level during a first duration time. When the first pulse and the second pulse are not concurrently received, the signal generator 400 may control the gate clock signal GK to have an activation level and may control the inverted gate clock signal GKB to have a deactivation level in response to the first pulse. In addition, the signal generator 400 may control the gate clock signal GK to have a deactivation level and may control the inverted gate clock signal GKB to have an activation level in response to the second pulse. For example, the signal generator 400 may be included in a power management integrated circuit (PMIC) that manages (or controls) power for the display device 1000.

The timing controller 500 may generate signals for controlling the gate driver 200, the data driver 300, and the signal generator 400. The timing controller 500 may receive a control signal CTL from an external component (e.g., a system board). The timing controller 500 may provide the first reference clock signal CKA and the second reference clock signal CKB to the signal generator 400 based on the control signal CTL. Here, the first reference clock signal CKA may have a pulse and the second reference clock signal CKB may have a pulse. The first and second reference clock signals may be signals for generating the vertical start signal STVP, the gate clock signal GK, and the inverted gate clock signal GKB. The timing controller 500 may generate a horizontal start signal, a data clock signal, etc as a data control signal DC for controlling the data driver 300. The timing controller 500 may generate the digital image data ODATA suitable for operating conditions of the display panel 100 based on input image data IDATA and may provide the digital image data ODATA to the data driver 300.

As described above, because the display device 1000 generates the vertical start signal STVP, the gate clock signal GK, and the inverted gate clock signal GKB for driving the gate driver 200 based on two signals (i.e., the first reference clock signal CKA and the second reference clock signal CKB), the display device 100 may reduce the number of wirings that are connected between the timing controller 500 and the signal generator 400 and may reduce a size of the panel driver (e.g., a size of a PCB).

Figure 2:
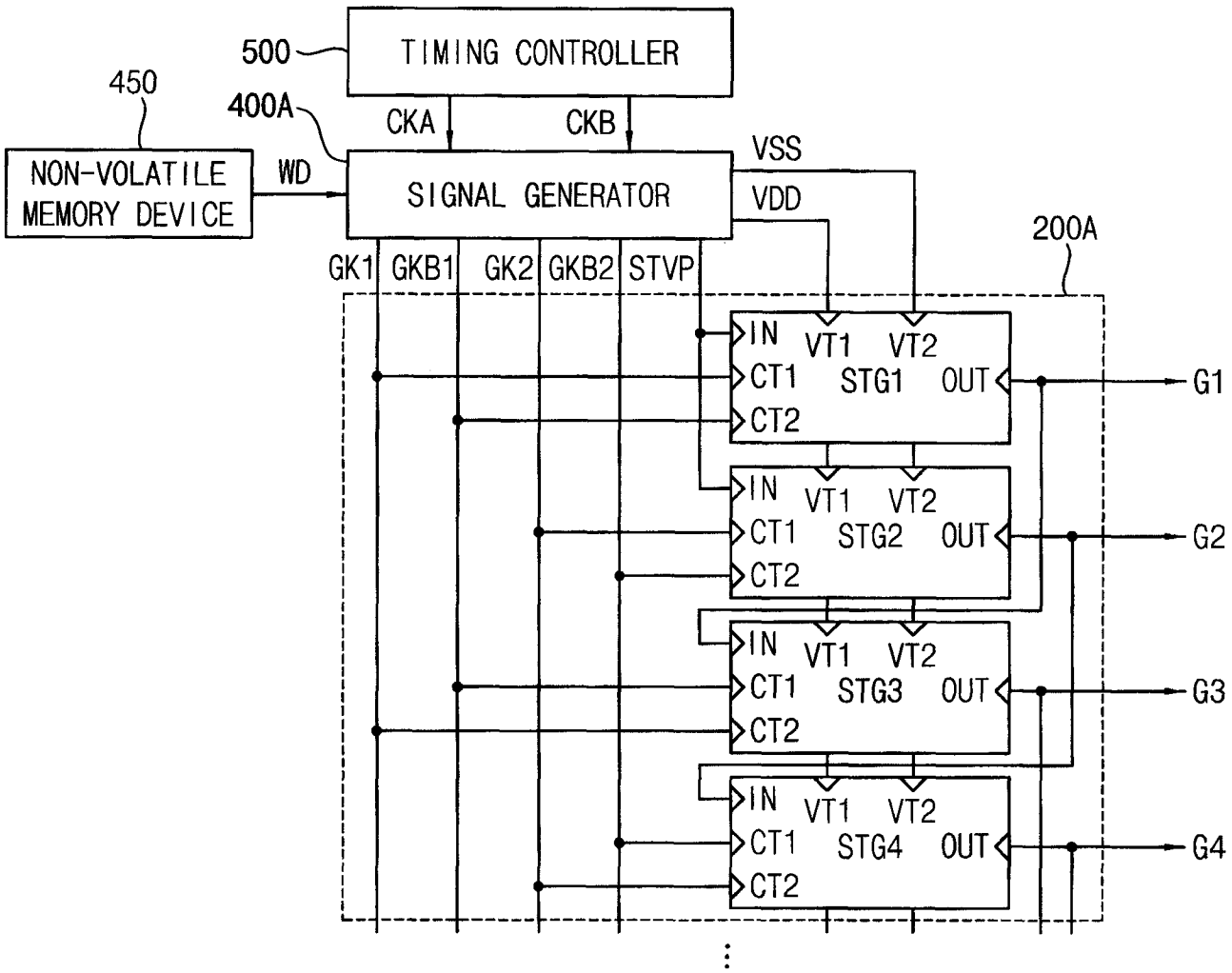
FIG. 2 is a block diagram illustrating examples of a signal generator and a gate driver included in the display device of FIG. 1.

FIG. 2 is a block diagram illustrating examples of a signal generator and a gate driver included in the display device of FIG. 1.

Referring to FIG. 2, the signal generator 400A may receive the first reference clock signal CKA and the second reference clock signal CKB from the timing controller 500 and may generate the vertical start signal STVP, the first and second gate clock signals GK1 and GK2, and the first and second inverted gate clock signals GKB1 and GKB2 based on the first reference clock signal CKA and the second reference clock signal CKB.

The signal generator 400A may control the vertical start signal STVP to have an activation level when the signal generator 400A concurrently receives the first pulse of the first reference clock signal CKA and the second pulse of the second reference clock signal CKB. The signal generator 400A may determine a length of an activation period of the vertical start signal STVP based on a duration time value WD received from a non-volatile memory device 450.

The non-volatile memory device 450 may store the duration time value WD. The non-volatile memory device 450 may retain data even when power is not supplied. For example, the non-volatile memory device 450 may include an electrically erasable programmable read-only memory (EEPROM) device, a flash memory device, an erasable programmable read-only memory (EPROM) device, a phase change random access memory (PRAM) device, an resistance random access memory (RRAM) device, etc.

The gate driver 200A may include a plurality of stages STG1, STG2, etc that output the gate signal based on the vertical start signal STVP, the first and second gate clock signals GK1 and GK2, and the first and second inverted gate clock signals GKB1 and GKB2. In some example embodiments, the gate driver 200A may be formed on the same substrate (i.e., a display substrate) on which the display panel 100 is formed.

In some example embodiments, each of the stages STG1, STG2, etc may include an input terminal IN, a first clock terminal CT1, a second clock terminal CT2, a first power terminal VT1, a second power terminal VT2, and an output terminal OUT.

Each of the first clock terminal CT1 and the second clock terminal CT2 of the stages STG1, STG2, etc may receive one of the first gate clock signal GK1, the second gate clock signal GK2, the first inverted gate clock signal GKB1, and the second inverted gate clock signal GKB2 which have different timings. The first inverted gate clock signal GKB1 may be an inverted signal of the first gate clock signal GK1. The second inverted gate clock signal GKB2 may be an inverted signal of the second gate clock signal GK2.

The first gate clock signal GK1 may be applied as the first clock signal to the first clock terminal CT1 of the (4p−3)-th stage (e.g., the first stage STG1), where p is an integer greater than 0. The first inverted gate clock signal GKB1 may be applied as the second clock signal to the second clock terminal CT2 of the (4p−3)-th stage.

The second gate clock signal GK2 may be applied as the first clock signal to the first clock terminal CT1 of the (4p−2)-th stage (e.g., the second stage STG2). The second inverted gate clock signal GKB2 may be applied as the second clock signal to the second clock terminal CT2 of the (4p−2)-th stage.

The first inverted gate clock signal GKB1 may be applied as the first clock signal to the first clock terminal CT1 of the (4p−1)-th stage (e.g., the third stage STG3). The first gate clock signal GK1 may be applied as the second clock signal to the second clock terminal CT2 of the (4p−1)-th stage.

The second inverted gate clock signal GKB2 may be applied as the first clock signal to the first clock terminal CT1 of the (4p)-th stage (e.g., the fourth stage STG4). The second gate clock signal GK2 may be applied as the second clock signal to the second clock terminal CT2 of the (4p)-th stage.

The vertical start signal STVP or one gate signal of previous stages may be applied to the input terminal IN of the stages STG1, STG2, etc. For example, the vertical start signal STVP may be applied to the input terminal IN of the first and second stages STG1 and STG2, and the gate signal of the (i−2)-th stage may be applied to the input terminal IN of the (i)-th stage, where i is an integer greater than 2. The gate signal G1, G2, etc may be output to the gate-line via the output terminal of the stages STG1, STG2, etc.

A first voltage VDD, which can turn on a switching transistor included in the pixel, may be applied to the first power terminal VT1 of the stages STG1, STG2, etc. For example, the first voltage VDD may be a high level voltage. A second voltage VSS, which can turn off the switching transistor, may be applied to the second power terminal VT2 of the stages STG1, STG2, etc. For example, the second voltage VSS may be a low level voltage.

Although it is illustrated in FIG. 2 that the duration time value WD is stored in the non-volatile memory device 450 which is independent of the signal generator 400A, the present inventive concept is not limited thereto. For example, the duration time value WD may be stored in the signal generator 400A.

Figure 3:
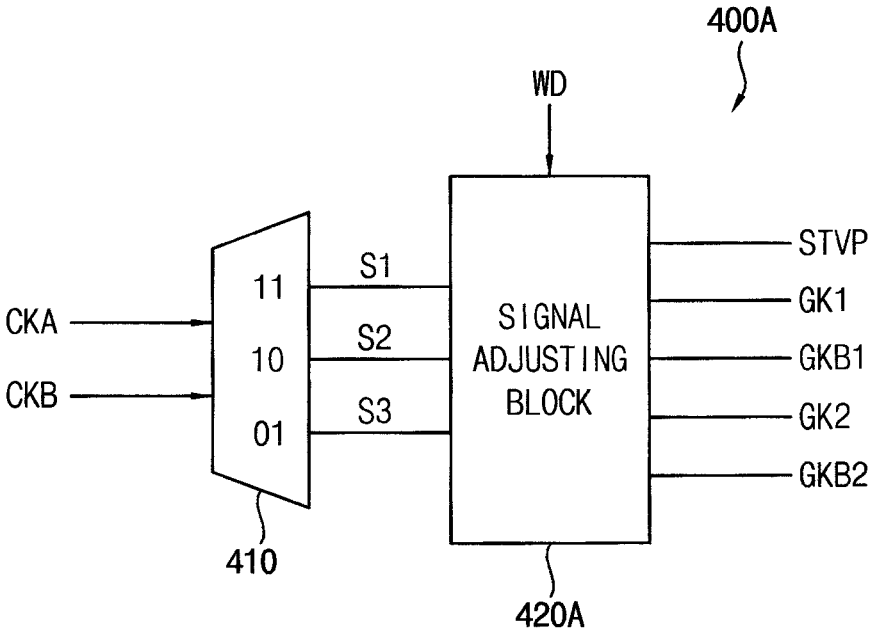
FIG. 3 is a diagram illustrating an example of the signal generator of FIG. 2.

FIG. 3 is a diagram illustrating an example of the signal generator of FIG. 2.

Referring to FIG. 3, the signal generator 400A may include a selecting block 410 and a signal adjusting block 420A.

The selecting block 410 may output first through third control signals S1 through S3 based on the first reference clock signal CKA and the second reference clock signal CKB. For example, the selecting block 410 may include a demultiplexer that receives the first reference clock signal CKA and the second reference clock signal CKB as a selection input signal and outputs the first through third control signals S1 through S3 according to voltage levels of the first reference clock signal CKA and the second reference clock signal CKB.

The signal adjusting block 420A may adjust voltage levels of the vertical start signal STVP, the first and second gate clock signals GK1 and GK2, and the inverted gate clock signal GKB1 and GKB2 based on the first through third control signals S1 through S3.

In some example embodiments, the selecting block 410 may activate the first control signal S1 when the first reference clock signal CKA and the second reference clock signal CKB correspond to an activation level. The signal adjusting block 420A may set the vertical start signal STVP to have an activation level based on the first control signal S1 which is activated. In addition, the signal adjusting block 420A may maintain the vertical start signal STVP to have an activation level during a first duration time which is determined by the duration time value WD.

In some example embodiments, the selecting block 410 may activate the second control signal S2 when the first reference clock signal CKA corresponds to an activation level and when the second reference clock signal CKB corresponds to a deactivation level. The signal adjusting block 420A may set the first gate clock signal GK1 or the second gate clock signal GK2 to have an activation level and may set the first inverted gate clock signal GKB1 or the second inverted gate clock signal GKB2 to have a deactivation level based on the second control signal S2 which is activated. For example, when the signal adjusting block 420A receives the second control signal S2 which is activated, the signal adjusting block 420A may alternately control (or set) the first gate clock signal GK1 or the second gate clock signal GK2 to have an activation level by using a counter that counts the number of pulses of the first reference clock signal CKA.

In some example embodiments, the selecting block 410 may activate the third control signal S3 when the first reference clock signal CKA corresponds to a deactivation level and when the second reference clock signal CKB corresponds to an activation level. The signal adjusting block 420A may set the first gate clock signal GK1 or the second gate clock signal GK2 to have a deactivation level and may set the first inverted gate clock signal GKB1 or the second inverted gate clock signal GKB2 to have an activation level based on the third control signal S3 which is activated. For example, when the signal adjusting block 420A receives the third control signal S3 which is activated, the signal adjusting block 420A may alternately control (or set) the first inverted gate clock signal GKB1 or the second inverted gate clock signal GKB2 to have an activation level by using a counter that counts the number of pulses of the second reference clock signal CKB.

Figure 4:
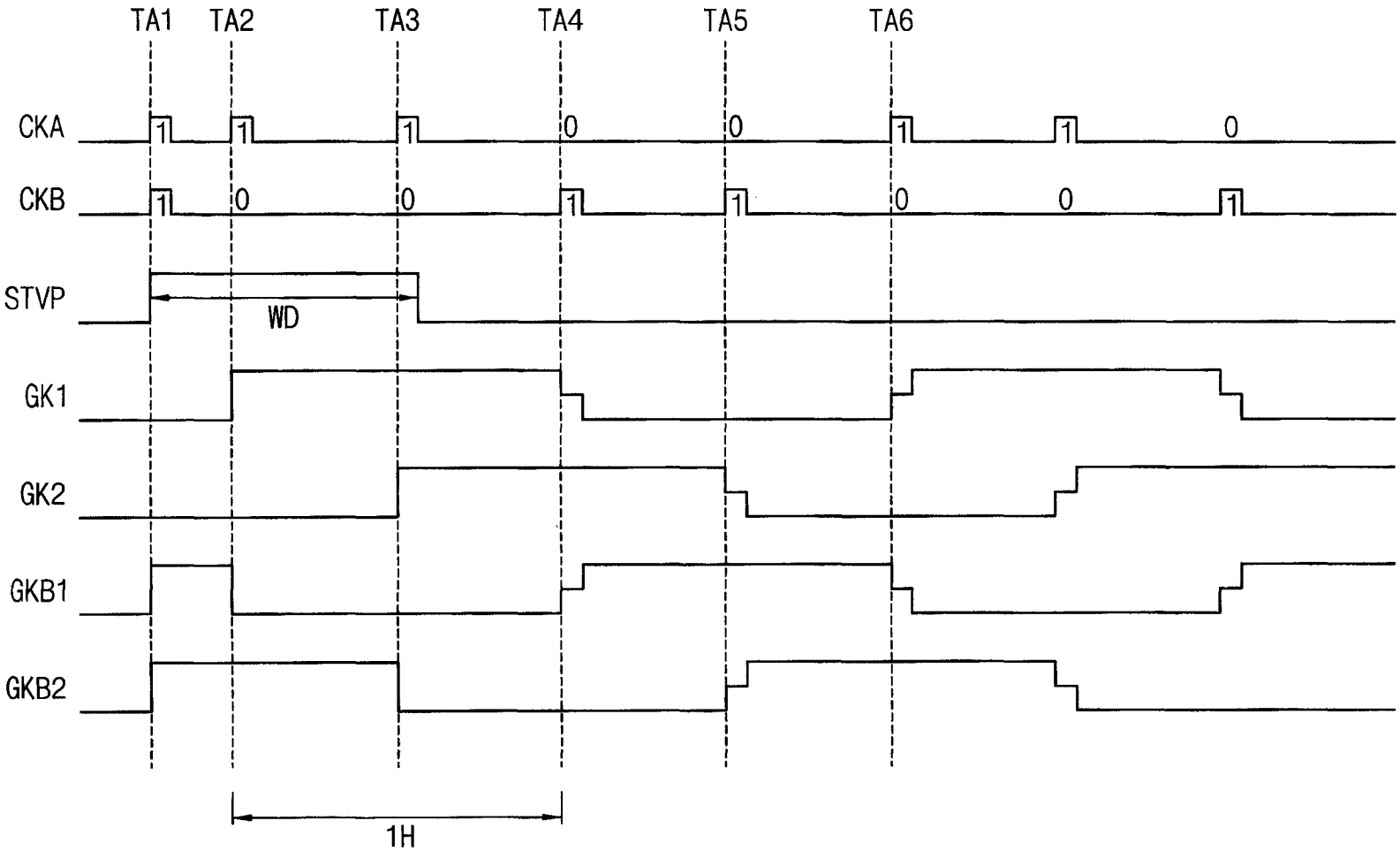
FIG. 4 is a timing diagram illustrating examples of an input signal and an output signal of the signal generator of FIG. 3.

FIG. 4 is a timing diagram illustrating examples of an input signal and an output signal of the signal generator of FIG. 3.

Referring to FIG. 4, the signal generator 400A may generate the vertical start signal STVP, the first and second gate clock signals GK1 and GK2, and the first and second inverted gate clock signals GKB1 and GKB2 based on the first reference clock signal CKA and the second reference clock signal CKB.

An activation period of the vertical start signal STVP may start in response to the first pulse of the first reference clock signal CKA and the second pulse of the second reference clock signal CKB. Activation periods of the first and second gate clock signals GK1 and GK2 may start in response to the first pulse of the first reference clock signal CKA. Deactivation periods of the first and second gate clock signals GK1 and GK2 may start in response to the second pulse of the second reference clock signal CKB. Activation periods of the first and second inverted gate clock signals GKB1 and GKB2 may start in response to the second pulse of the second reference clock signal CKB. Deactivation periods of the first and second inverted gate clock signals GKB1 and GKB2 may start in response to the first pulse of the first reference clock signal CKA.

For example, at a first timing point TA1, the vertical start signal STVP may be controlled to have an activation level in response to the first pulse of the first reference clock signal CKA and the second pulse of the second reference clock signal CKB. The vertical start signal STVP may be maintained to have an activation level during the first duration time WD.

At a second timing point TA2, in response to the first pulse of the first reference clock signal CKA, the first gate clock signal GK1 may be controlled to have an activation level, and the first inverted gate clock signal GKB1 may be controlled to have a deactivation level.

At a third timing point TA3, in response to the first pulse of the first reference clock signal CKA, the second gate clock signal GK2 may be controlled to have an activation level, and the second inverted gate clock signal GKB2 may be controlled to have a deactivation level.

At a fourth timing point TA4, in response to the second pulse of the second reference clock signal CKB, the first inverted gate clock signal GKB1 may be controlled to have an activation level, and the first gate clock signal GK1 may be controlled to have a deactivation level.

At a fifth timing point TA5, in response to the second pulse of the second reference clock signal CKB, the second inverted gate clock signal GKB2 may be controlled to have an activation level, and the second gate clock signal GK2 may be controlled to have a deactivation level.

At a sixth timing point TA6, in response to the first pulse of the first reference clock signal CKA, the first gate clock signal GK1 may be controlled to have an activation level, and the first inverted gate clock signal GKB1 may be controlled to have a deactivation level.

Thus, the second gate clock signal GK2 output from the signal generator 400A may be a signal generated by delaying the first gate clock signal GK1 by ½ of a horizontal time, and the second inverted gate clock signal GKB2 may be a signal generated by delaying the first inverted gate clock signal GKB1 by ½ of the horizontal time.

Although it is illustrated in FIG. 4 that the gate clock signal and the inverted gate clock signal rises or falls in a step manner by charge sharing operations between the gate clock signal and the inverted gate clock signal in a region where the vertical start signal STVP is deactivated, the gate clock signal and the inverted gate clock signal may rise or fall without the charge sharing operations.

Figure 5:
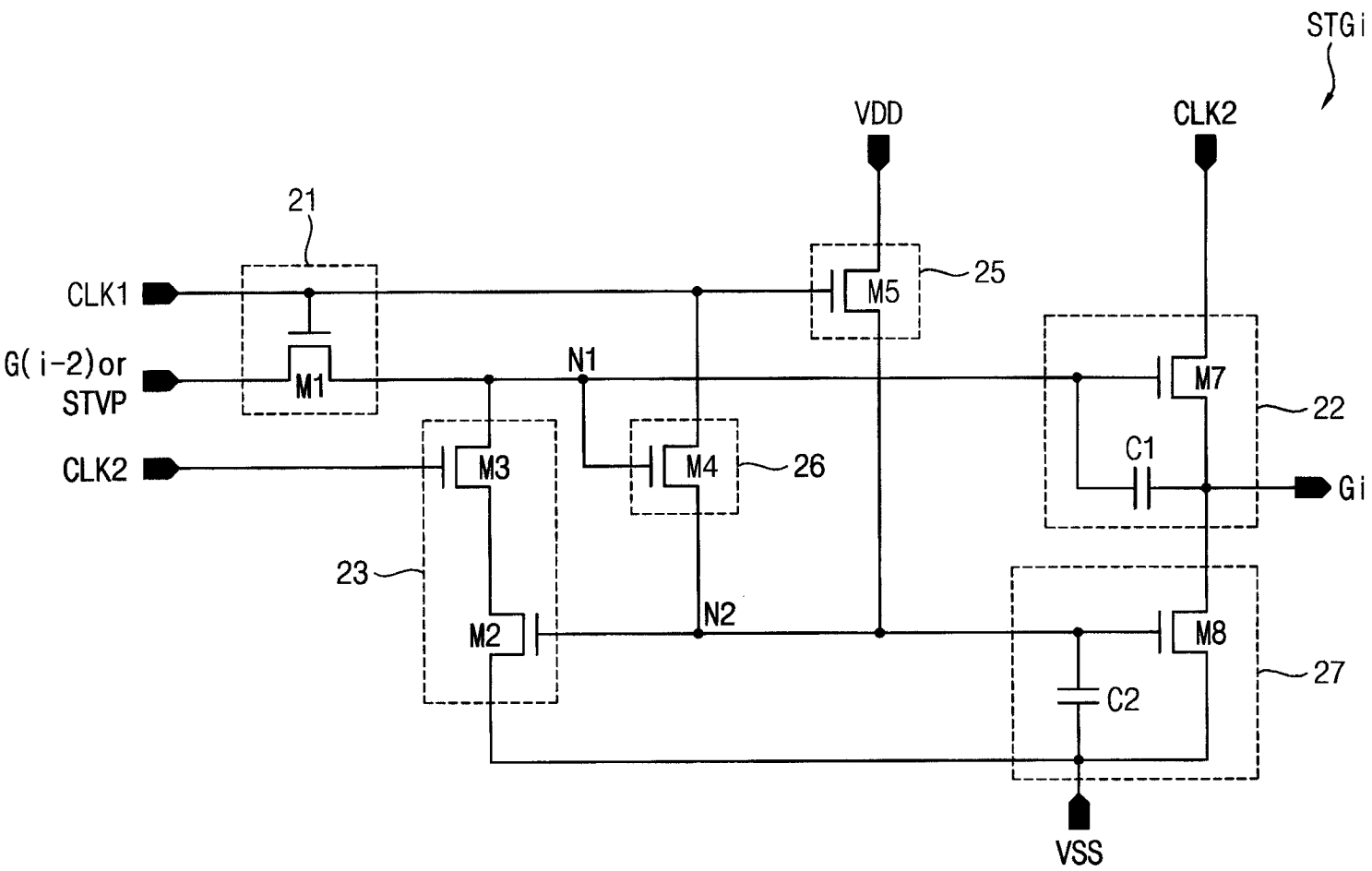
FIG. 5 is a circuit diagram illustrating an example of a stage included in the gate driver of FIG. 2.

FIG. 5 is a circuit diagram illustrating an example of a stage included in the gate driver of FIG. 2.

Referring to FIG. 5, each stage STGi of the gate driver 200A may include a first input block 21, a second input block 26, a first output block 22, a second output block 27, a stabilizing block 23, and a holding block 25.

The first input block 21 may receive the vertical start signal STVP or one output signal G(i−2) of previous stages as an input signal and may apply the input signal to a first node N1 in response to the first clock signal CLK1. In some example embodiments, the first input block 21 may include a first input transistor M1. The first input transistor M1 may include a gate electrode that receives the first clock signal CLK1, a first electrode that receives the input signal, and a second electrode that is connected to the first node N1.

The second input block 26 may apply the first clock signal CLK1 to a second node N2 in response to a signal of the first node N1. In some example embodiments, the second input block 26 may include a second input transistor M4. The second input transistor M4 may include a gate electrode that is connected to the first node N1, a first electrode that receives the first clock signal CLK1, and a second electrode that is connected to the second node N2.

The first output block 22 may control the gate signal Gi to have an activation level in response to the signal of the first node N1. In some example embodiments, the first output block 22 may include a first output transistor M7 and a first capacitor C1. The first output transistor M7 may include a gate electrode that is connected to the first node N1, a first electrode that receives the second clock signal CLK2, and a second electrode that is connected to an output terminal at which the gate signal Gi is output. The first capacitor C1 may include a first electrode that is connected to the first node N1 and a second electrode that is connected to the output terminal.

The second output block 27 may control the gate signal Gi to have a deactivation level in response to a signal of the second node N2. In some example embodiments, the second output block 27 may include a second output transistor M8 and a second capacitor C2. The second output transistor M8 may include a gate electrode that is connected to the second node N2, a first electrode that receives the second voltage VSS, and a second electrode that is connected to the output terminal. The second capacitor C2 may include a first electrode that is connected to the second node N2 and a second electrode that receives the second voltage VSS.

The stabilizing block 23 may stabilize the gate signal Gi in response to the signal of the second node N2 and the second clock signal CLK2. In some example embodiments, the stabilizing block 23 may include a first stabilization transistor M2 and a second stabilization transistor M3. The first stabilization transistor M2 may include a gate electrode that is connected to the second node N2, a first electrode that receives the second voltage VSS, and a second electrode. The second stabilization transistor M3 may include a gate electrode that receives the second clock signal CLK2, a first electrode that is connected to the second electrode of the first stabilization transistor M2, and a second electrode that is connected to the first node N1.

The holding block 25 may maintain the second node N2 to have the first voltage VDD in response to the first clock signal CLK1. In some example embodiments, the first holding block 25 may include a holding transistor M5. The holding transistor M5 may include a gate electrode that receives the first clock signal CLK1, a first electrode that receives the first voltage VDD, and a second electrode that is connected to the second node N2.

Although it is illustrated in FIG. 5 that the gate driver 200A includes stages each having seven transistors and two capacitors, the gate driver 200A may be implemented by various structures that generate the gate signal based on the vertical start signal and the clock signals.

Figure 6:
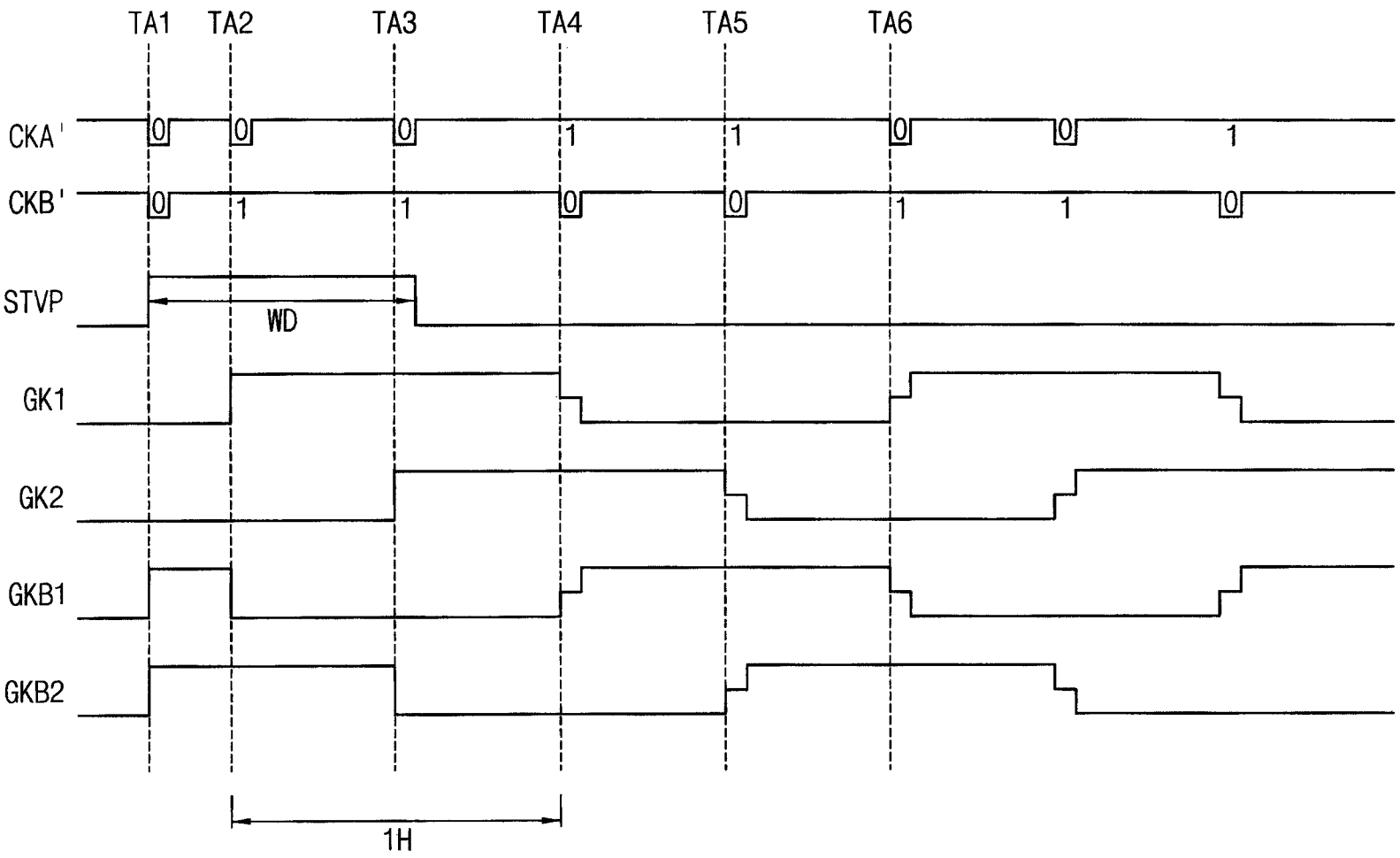
FIG. 6 is a timing diagram illustrating examples of an input signal and an output signal of the signal generator of FIG. 3.

FIG. 6 is a timing diagram illustrating examples of an input signal and an output signal of the signal generator of FIG. 3.

Referring to FIG. 6, the signal generator 400A may generate the vertical start signal STVP, the first and second gate clock signals GK1 and GK2, and the first and second inverted gate clock signals GKB1 and GKB2 based on the first reference clock signal CKA' and the second reference clock signal CKB'. An activation level of the first and second reference clock signals CKA' and CKB' may correspond to a low voltage level. A deactivation level of the first and second reference clock signals CKA' and CKB' may correspond to a high voltage level. Except the activation level and the deactivation level of the first and second reference clock signals CKA' and CKB', a driving method of the signal generator 400A may be substantially the same as the driving method of the signal generator 400A illustrated in FIG. 2. Thus, duplicated description will not be repeated.

Figure 7:
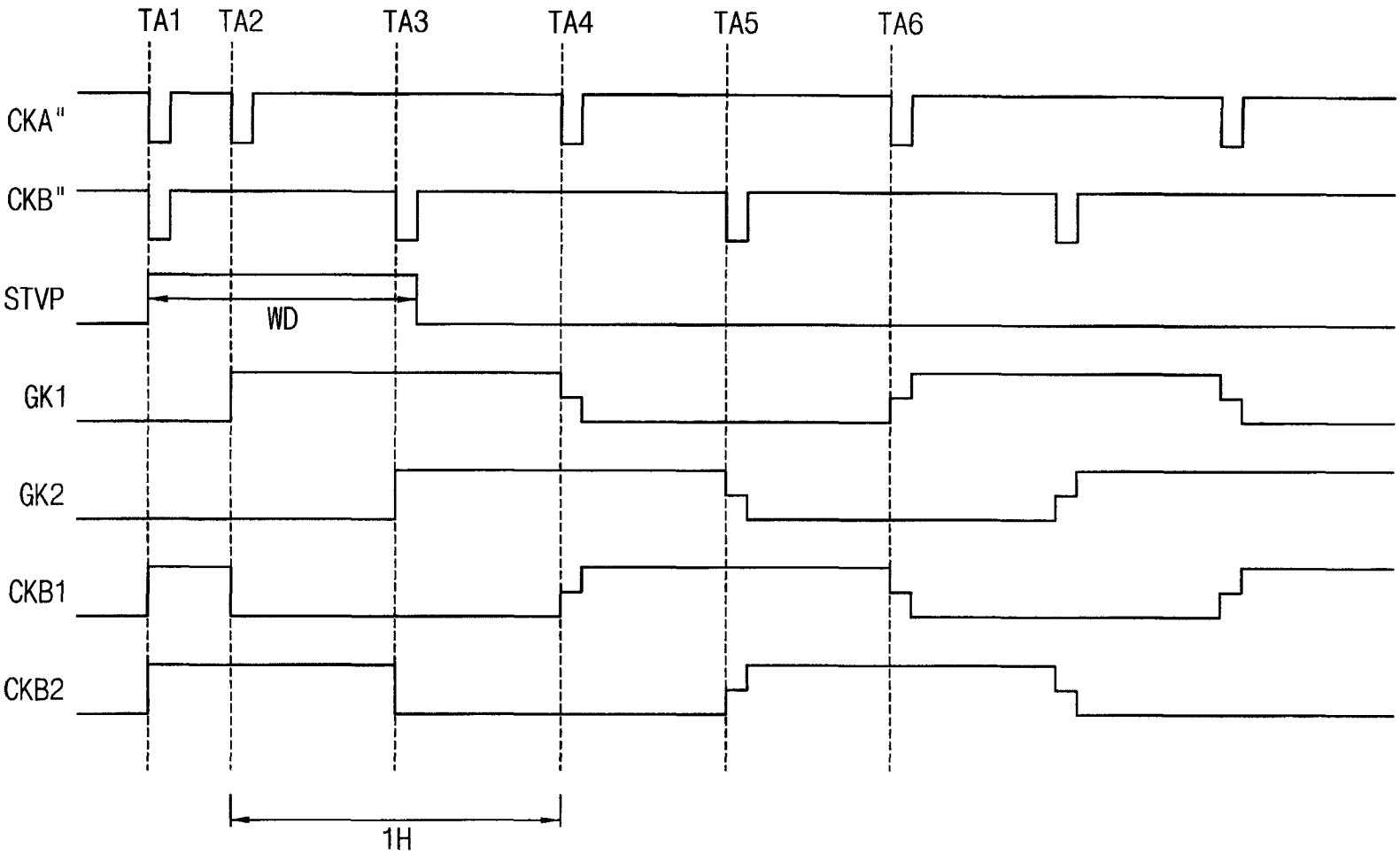
FIG. 7 is a timing diagram illustrating examples of an input signal and an output signal of the signal generator of FIG. 3.

FIG. 7 is a timing diagram illustrating examples of an input signal and an output signal of the signal generator of FIG. 3.

Referring to FIG. 7, the signal generator 400A may generate the vertical start signal STVP, the first and second gate clock signals GK1 and GK2, and the first and second inverted gate clock signals GKB1 and GKB2 based on the first reference clock signal CKA" and the second reference clock signal CKB". An activation level of the first and second reference clock signals CKA" and CKB" may correspond to a low voltage level. A deactivation level of the first and second reference clock signals CKA" and CKB" may correspond to a high voltage level. Except how the gate clock signals and the inverted gate clock signals are controlled according to the reference clock signals, a driving method of the signal generator 400A may be substantially the same as the driving method of the signal generator 400A illustrated in FIG. 6. Thus, duplicated description will not be repeated.

An activation period of the vertical start signal STVP may start in response to the first pulse of the first reference clock signal CKA" and the second pulse of the second reference clock signal CKB". The first gate clock signal GK1 and the first inverted gate clock signal GKB1 may be inverted based on the first pulse of the first reference clock signal CKA" (i.e., may be changed from a deactivation level to an activation level or may be changed from an activation level to a deactivation level). The second gate clock signal GK2 and the second inverted gate clock signal GKB2 may be inverted based on the second pulse of the second reference clock signal CKB".

For example, at a first timing point TA1, the vertical start signal STVP may be controlled to have an activation level in response to the first pulse of the first reference clock signal CKA" and the second pulse of the second reference clock signal CKB". The vertical start signal STVP may be maintained to have an activation level during the first duration time WD.

At a second timing point TA2, in response to the first pulse of the first reference clock signal CKA", the first gate clock signal GK1 may be controlled to have an activation level, and the first inverted gate clock signal GKB1 may be controlled to have a deactivation level.

At a third timing point TA3, in response to the second pulse of the second reference clock signal CKB", the second gate clock signal GK2 may be controlled to have an activation level, and the second inverted gate clock signal GKB2 may be controlled to have a deactivation level.

At a fourth timing point TA4, in response to the first pulse of the first reference clock signal CKA", the first inverted gate clock signal GKB1 may be controlled to have an activation level, and the first gate clock signal GK1 may be controlled to have a deactivation level.

At a fifth timing point TA5, in response to the second pulse of the second reference clock signal CKB", the second inverted gate clock signal GKB2 may be controlled to have an activation level, and the second gate clock signal GK2 may be controlled to have a deactivation level.

At a sixth timing point TA6, in response to the first pulse of the first reference clock signal CKA", the first gate clock signal GK1 may be controlled to have an activation level, and the first inverted gate clock signal GKB1 may be controlled to have a deactivation level.

Figure 8:
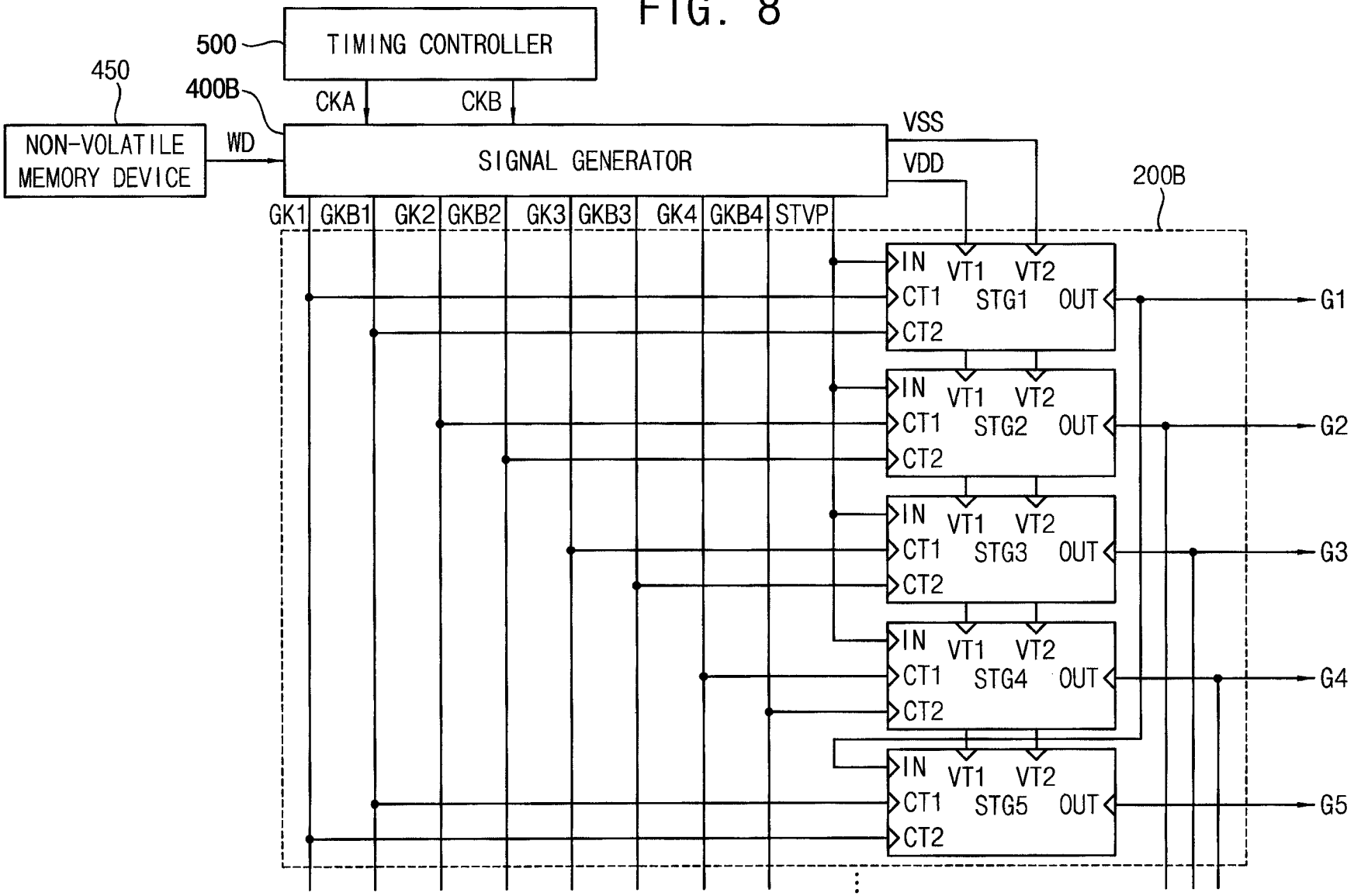
FIG. 8 is a block diagram illustrating examples of a signal generator and a gate driver included in the display device of FIG. 1.

FIG. 8 is a block diagram illustrating examples of a signal generator and a gate driver included in the display device of FIG. 1.

Referring to FIG. 8, the signal generator 400B may receive the first reference clock signal CKA and the second reference clock signal CKB from the timing controller 500 and may generate the vertical start signal STVP, the first through fourth gate clock signals GK1, GK2, GK3 and GK2, and the first through fourth inverted gate clock signals GKB1, GKB2, GKB3 and GKB4 based on the first reference clock signal CKA and the second reference clock signal CKB. Except that the signal generator 400B generates four gate clock signals and four inverted gate clock signals, the signal generator 400B may be substantially the same as the signal generator 400A of FIG. 2. Thus, the same reference numerals will be used for the same or similar components, and duplicated description will not be repeated.

The signal generator 400B may control the vertical start signal STVP to have an activation level when the signal generator 400B concurrently receives the first pulse of the first reference clock signal CKA and the second pulse of the second reference clock signal CKB. The signal generator 400B may determine a length of an activation period of the vertical start signal STVP based on the duration time value WD received from the non-volatile memory device 450.

The non-volatile memory device 450 may store the duration time value WD.

The gate driver 200B may include a plurality of stages STG1, STG2, etc each outputting the gate signal based on the vertical start signal STVP, the first through fourth gate clock signals GK1 through GK4, and the first through fourth inverted gate clock signals GKB1 through GKB4. Except that the gate driver 200B generates the gate signal based on four gate clock signals and four inverted gate clock signals, the gate driver 200B may be substantially the same as the gate driver 200A of FIG. 2. Thus, the same reference numerals will be used for the same or similar components, and duplicated description will not be repeated.

Each of the stages STG1, STG2, etc. may include the input terminal IN, the first clock terminal CT1, the second clock terminal CT2, the first power terminal VT1, the second power terminal VT2, and the output terminal OUT. Each of the first clock terminal CT1 and the second clock terminal CT2 of the stages STG1, STG2, etc. may receive one of the first gate clock signal GK1, the second gate clock signal GK2, the third gate clock signal GK3, the fourth gate clock signal GK4, the first inverted gate clock signal GKB1, the second inverted gate clock signal GKB2, the third inverted gate clock signal GKB3, and the fourth inverted gate clock signal GKB4 which have different timings.

The input terminal IN of the stages STG1, STG2, etc may receive the vertical start signal STVP or one gate signal of previous stages. For example, the vertical start signal STVP may be applied to the input terminal IN of the first through fourth stages STG1 through STG4, and the gate signal of the (i−4)-th stage may be applied to the input terminal IN of the (i)-th stage, where i is an integer greater than 4. The gate signals G1, G2, etc. may be output to the gate-lines via the output terminal OUT of the stages STG1, STG2, etc.

Figure 9:
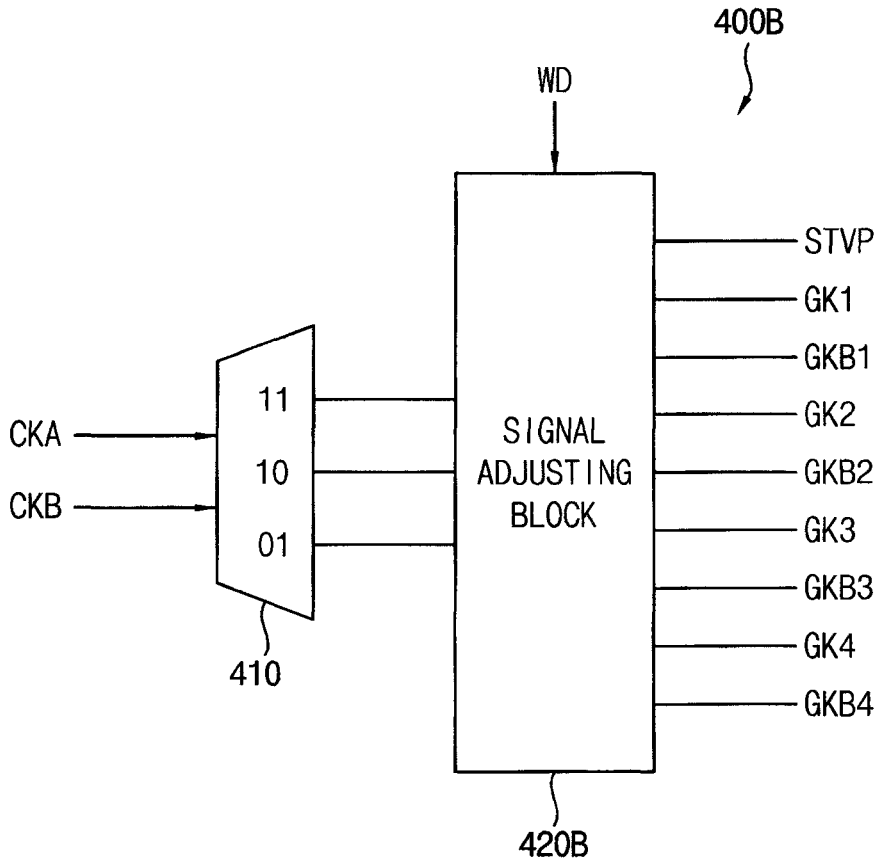
FIG. 9 is a diagram illustrating an example of the signal generator of FIG. 8.

FIG. 9 is a diagram illustrating an example of the signal generator of FIG. 8.

Referring to FIG. 9, the signal generator 400B may include a selecting block 410 and a signal adjusting block 420B. Except that the signal adjusting block 420B outputs four gate clock signals and four inverted gate clock signals, the signal generator 400B may be the same as (or substantially the same as) the signal generator 400A of FIG. 3. Thus, the same reference numerals will be used for the same or similar components, and some duplicated description will not be repeated.

The selecting block 410 may output the first through third control signals S1 through S3 based on the first reference clock signal CKA and the second reference clock signal CKB.

The signal adjusting block 420B may adjust voltage levels of the vertical start signal STVP, the first through fourth gate clock signals GK1 through GK4, and the first through fourth inverted gate clock signals GKB1 through GKB4 based on the first through third control signals S1 through S3.

Figure 10:
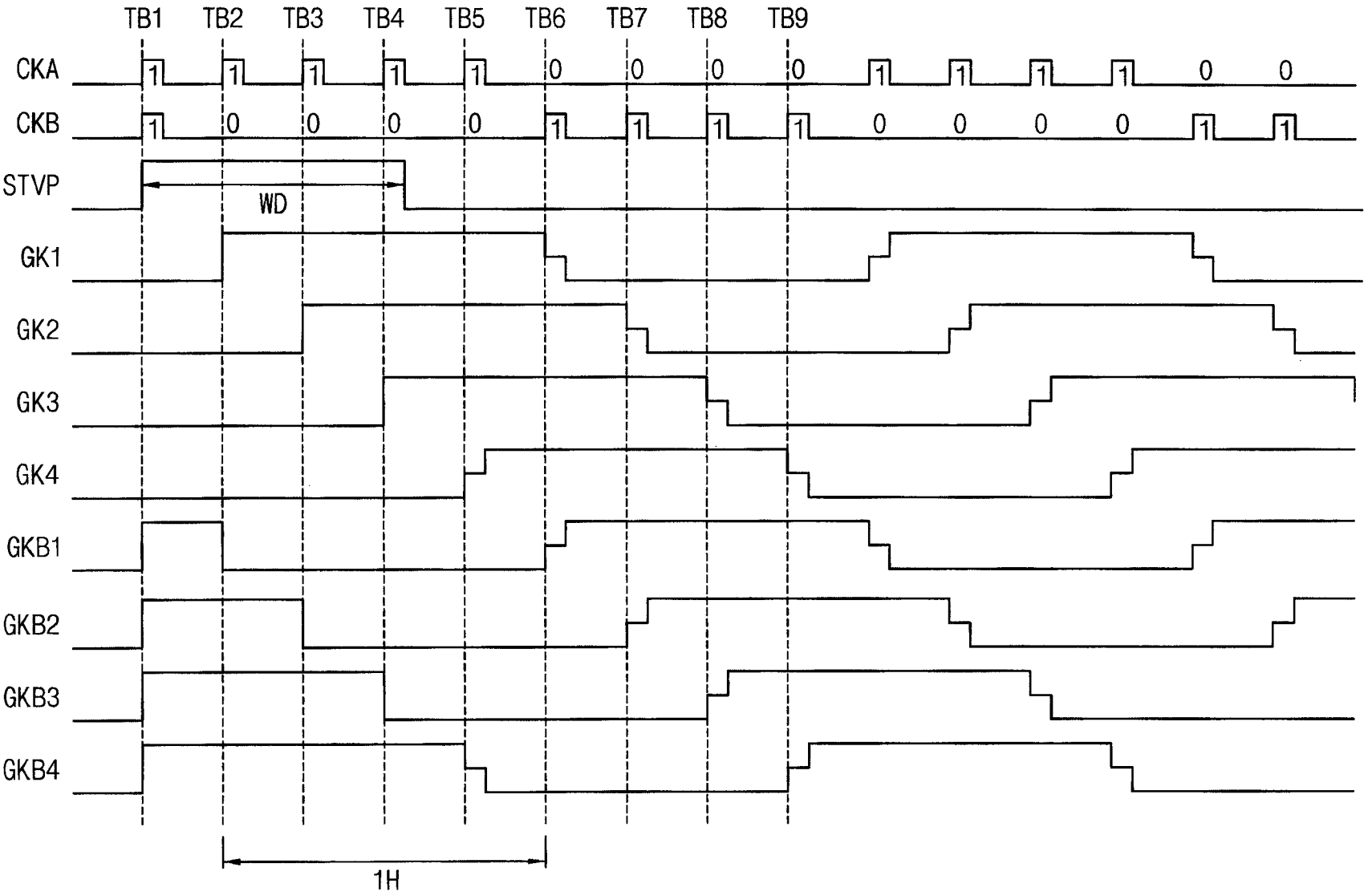
FIG. 10 is a timing diagram illustrating examples of an input signal and an output signal of the signal generator of FIG. 9.

FIG. 10 is a timing diagram illustrating examples of an input signal and an output signal of the signal generator of FIG. 9.

Referring to FIG. 10, the signal generator 400B may generate the vertical start signal STVP, the first through fourth gate clock signals GK1 through GK4, and the first through fourth inverted gate clock signals GKB1 through GKB4 based on the first reference clock signal CKA and the second reference clock signal CKB.

At a first timing point TB1, the vertical start signal STVP may be controlled to have an activation level in response to the first pulse of the first reference clock signal CKA and the second pulse of the second reference clock signal CKB. The vertical start signal STVP may be maintained to have an activation level during the first duration time WD.

At second through fifth timing points TB2 through TBS, in response to the first pulse of the first reference clock signal CKA, the first through fourth gate clock signals GK1 through GK4 may be sequentially controlled to have an activation level, and the first through fourth inverted gate clock signals GKB1 through GKB4 may be sequentially controlled to have a deactivation level.

At sixth through ninth timing points TB6 through TB9, in response to the second pulse of the second reference clock signal CKB, the first through fourth inverted gate clock signals GKB1 through GKB4 may be sequentially controlled to have an activation level, and the first through fourth gate clock signals GK1 through GK4 may be sequentially controlled to have a deactivation level.

Figure 11:
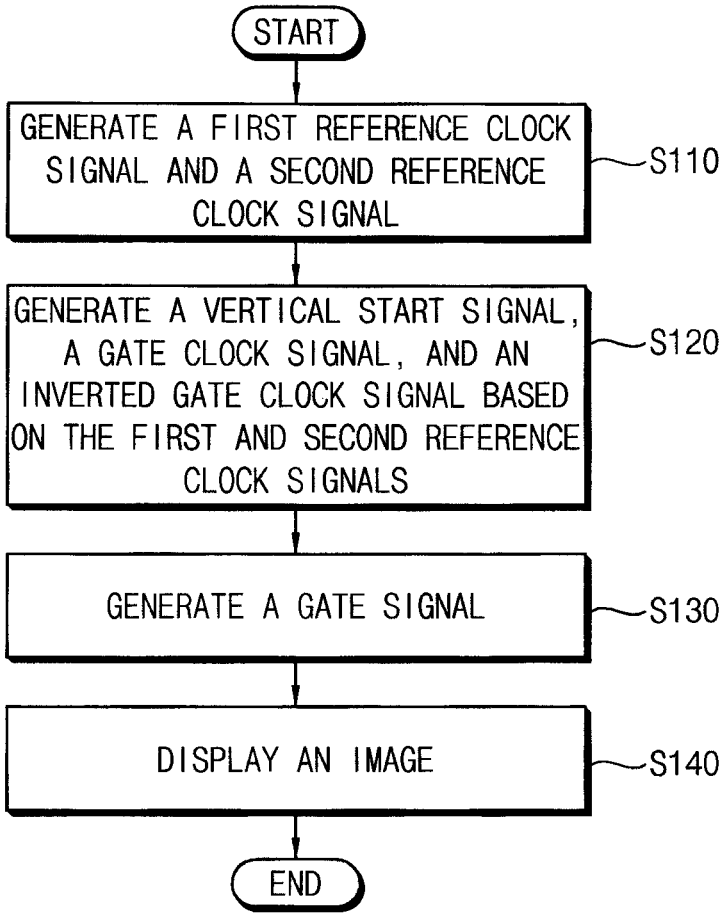
FIG. 11 is a flowchart illustrating a method of driving a display device according to some example embodiments.

FIG. 11 is a flowchart illustrating a method of driving a display device according to some example embodiments.

Referring to FIG. 11, the method of FIG. 11 may simplify a panel driver by generating a vertical start signal based on a first reference clock signal and a second reference clock signal.

The method of FIG. 11 may generate the first reference clock signal having a first pulse and the second reference clock signal having a second pulse (S110).

The method of FIG. 11 may generate the vertical start signal, a gate clock signal, and an inverted gate clock signal based on the first reference clock signal and the second reference clock signal (S120). The vertical start signal may be set to have an activation level when the first and second reference clock signals corresponding to an activation level. The vertical start signal may be maintained to have an activation level during a first duration time which is determined based on a duration time value received from a memory device. In some example embodiments, when the first reference clock signal corresponds to an activation level and when the second reference clock signal corresponds to a deactivation level, the gate clock signal may be set to have an activation level, and the inverted gate clock signal may be set to have a deactivation level. When the first reference clock signal corresponds to a deactivation level and when the second reference clock signal corresponds to an activation level, the gate clock signal may be set to have a deactivation level, and the inverted gate clock signal may be set to have an activation level. Because a method of generating the vertical start signal, the gate clock signal, and the inverted gate clock signal based on the first reference clock signal and the second reference clock signal is described above, duplicated description related thereto will not be repeated.

The method of FIG. 11 may generate the gate signal based on the vertical start signal, the gate clock signal, and the inverted gate clock signal (S130).

The method of FIG. 11 may display an image corresponding to a data signal in response to the gate signal (S140).

As described above, a display device and a method of driving the display device according to some example embodiments may be implemented without an additional wiring for generating the vertical start signal by generating the vertical start signal as well as the gate clock signal based on the first reference clock signal and the second reference clock signal.

Although a display device and a method of driving the display device according to some example embodiments have been described with reference to figures, those skilled in the art will readily appreciate that many modifications are possible in the example embodiments without materially departing from the novel teachings and characteristics of the present inventive concept. For example, although it is described above that a gate driver is formed on a display substrate, forming the gate driver is not limited thereto. For example, the gate driver may be formed in a chip form and mounted on a display panel.

The present inventive concept may be applied to an electronic device including a display device. For example, the present inventive concept may be applied to a computer, a laptop, a cellular phone, a smart phone, a smart pad, a portable media player (PMP), a personal digital assistant (PDA), an MP3 player, a digital camera, a video camcorder, etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of some example embodiments and is not to be construed as limiting thereof. Although a few example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a display panel including a plurality of pixels;

a timing controller configured to generate a first reference clock signal having a first pulse and a second reference clock signal having a second pulse;

a signal generator configured to generate a vertical start signal of which an activation period starts in response to concurrently receiving the first pulse and the second pulse, and to generate a gate clock signal and an inverted gate clock signal based on the first pulse and the second pulse; and a gate driver configured to generate a gate signal based on the vertical start signal, the gate clock signal, and the inverted gate clock signal and to provide the gate signal to the pixels.

2. The display device of claim 1, wherein the signal generator is configured to activate the vertical start signal when the signal generator concurrently receives the first pulse and the second pulse.

3. The display device of claim 2, wherein the signal generator is configured to determine a length of the activation period of the vertical start signal based on a duration time value received from a memory device.

4. The display device of claim 1, wherein an activation period of the gate clock signal starts in response to the first pulse and a deactivation period of the gate clock signal starts in response to the second pulse, and wherein an activation period of the inverted gate clock signal starts in response to the second pulse and a deactivation period of the inverted gate clock signal starts in response to the first pulse.

5. The display device of claim 1, wherein a voltage level of the gate clock signal is inverted in response to the first pulse.

6. The display device of claim 1, wherein the signal generator includes:

a selecting block configured to output first through third control signals based on the first reference clock signal and the second reference clock signal; and a signal adjusting block configured to adjust voltage levels of the vertical start signal, the gate clock signal, and the inverted gate clock signal based on the first through third control signals.

7. The display device of claim 6, wherein the selecting block is configured to activate the first control signal when the first reference clock signal and the second reference clock signal correspond to an activation level, and wherein the signal adjusting block sets the vertical start signal to have an activation level based on the first control signal which is activated.

8. The display device of claim 7, wherein the signal adjusting block is configured to maintain the vertical start signal to have the activation level during a first duration time.

9. The display device of claim 6, wherein the selecting block is configured to activate the second control signal when the first reference clock signal corresponds to an activation level and when the second reference clock signal corresponds to a deactivation level, and wherein the signal adjusting block is configured to set the gate clock signal to have an activation level and to set the inverted gate clock signal to have a deactivation level based on the second control signal which is activated.

10. The display device of claim 6, wherein the selecting block is configured to activate the third control signal when the first reference clock signal corresponds to a deactivation level and when the second reference clock signal corresponds to an activation level, and wherein the signal adjusting block is configured to set the gate clock signal to have a deactivation level and to set the inverted gate clock signal to have an activation level based on the third control signal which is activated.

11. The display device of claim 1, wherein the gate clock signal includes first through (k)-th gate clock signals, where k is an integer greater than 1, wherein the inverted gate clock signal includes first through (k)-th inverted gate clock signals, and wherein the first through (k)-th inverted gate clock signals correspond to respective inverted signals of the first through (k)-th gate clock signals.

12. The display device of claim 11, wherein an (i)-th gate clock signal is a signal generated by delaying an (i−1)-th gate clock signal by a first time length, where i is an integer greater than 1 and smaller than or equal to k, and wherein an (i)−th inverted gate clock signal is a signal generated by delaying an (i−1)-th inverted gate clock signal by the first time length.

13. A display device comprising:

a display panel including a plurality of pixels;

a timing controller configured to generate a first reference clock signal and a second reference clock signal;

a signal generator configured to generate a vertical start signal, a gate clock signal, and an inverted gate clock signal based on concurrently receiving the first reference clock signal and the second reference clock signal; and a gate driver configured to generate a gate signal based on the vertical start signal, the gate clock signal, and the inverted gate clock signal and to provide the gate signal to the pixels, wherein the signal generator is configured to set the vertical start signal to have an activation level when the first reference clock signal and the second reference clock signal correspond to an activation level.

14. The display device of claim 13, wherein the signal generator includes a signal adjusting block configured to maintain the vertical start signal to have the activation level during a first duration time.

15. The display device of claim 13, wherein the signal generator includes a selecting block configured to set the gate clock signal to have an activation level and to set the inverted gate clock signal to have a deactivation level when the first reference clock signal corresponds to the activation level and when the second reference clock signal corresponds to a deactivation level.

16. The display device of claim 15, wherein the selecting block is configured to set the gate clock signal to have a deactivation level and to set the inverted gate clock signal to have an activation level when the first reference clock signal corresponds to the deactivation level and when the second reference clock signal corresponds to the activation level.

17. A method of driving a display device, the method comprising:

generating a first reference clock signal and a second reference clock signal;

generating a vertical start signal, a gate clock signal, and an inverted gate clock signal in response a signal generator concurrently receiving the first reference clock signal and the second reference clock signal;

generating a gate signal based on the vertical start signal, the gate clock signal, and the inverted gate clock signal; and displaying an image corresponding to a data signal in response to the gate signal, wherein the vertical start signal is set to have an activation level when the first reference clock signal and the second reference clock signal correspond to an activation level.

18. The method of claim 17, wherein the vertical start signal is maintained to have the activation level during a first duration time which is determined based on a duration time value received from a memory device.

19. The method of claim 17, wherein the gate clock signal is set to have an activation level and the inverted gate clock signal is set to have a deactivation level when the first reference clock signal corresponds to the activation level and when the second reference clock signal corresponds to a deactivation level.

20. The method of claim 19, wherein the gate clock signal is set to have a deactivation level and the inverted gate clock signal is set to have an activation level when the first reference clock signal corresponds to the deactivation level and when the second reference clock signal corresponds to the activation level.

* * * * *